US008726425B2

(12) United States Patent
Murakami

(10) Patent No.: US 8,726,425 B2
(45) Date of Patent: May 20, 2014

(54) WAKE STABILIZER FOR HELMET AND HELMET

(75) Inventor: Takeshi Murakami, Higashi-Osaka (JP)

(73) Assignee: OGK Kabuto Co., Ltd., Osaka (JP)

( * ) Notice: Subject to any disclaimer, the term of this patent is extended or adjusted under 35 U.S.C. 154(b) by 729 days.

(21) Appl. No.: 12/303,919

(22) PCT Filed: Jun. 13, 2006

(86) PCT No.: PCT/JP2006/311810

§ 371 (c)(1),
(2), (4) Date: Dec. 8, 2008

(87) PCT Pub. No.: WO2007/144937

PCT Pub. Date: Dec. 21, 2007

(65) Prior Publication Data

US 2010/0229289 A1 Sep. 16, 2010

(51) Int. Cl.
*A42B 3/04* (2006.01)

(52) U.S. Cl.
USPC ..... 2/425; 2/410; 2/455

(58) Field of Classification Search
USPC ..... 2/455, 410, 425
See application file for complete search history.

(56) References Cited

U.S. PATENT DOCUMENTS

| | | | | | |
|---|---|---|---|---|---|
| 4,370,758 | A | * | 2/1983 | Mattheis | 2/423 |
| 4,586,197 | A | * | 5/1986 | Hubbard | 2/410 |
| 4,903,350 | A | * | 2/1990 | Gentes et al. | 2/421 |
| 5,097,538 | A | * | 3/1992 | Feuling | 2/410 |
| 5,271,102 | A | * | 12/1993 | Feuling | 2/410 |
| 5,361,419 | A | * | 11/1994 | Bernstein | 2/423 |
| 5,575,018 | A | * | 11/1996 | Rothrock | 2/424 |
| 5,996,128 | A | * | 12/1999 | Yanagihara | 2/422 |
| 6,263,513 | B1 | * | 7/2001 | Murakami | 2/171.3 |
| D454,987 | S | * | 3/2002 | Hahm | D29/122 |
| D457,274 | S | * | 5/2002 | Taniuchi et al. | D29/122 |
| D457,691 | S | * | 5/2002 | Taniuchi et al. | D29/122 |
| D460,219 | S | * | 7/2002 | Taniuchi et al. | D29/122 |
| 6,553,580 | B1 | | 4/2003 | Henson | |

FOREIGN PATENT DOCUMENTS

| | | | |
|---|---|---|---|
| EP | 0 650 673 | A1 | 5/1995 |
| EP | 1 405 575 | A2 | 4/2004 |
| EP | 1 405 575 | A3 | 4/2004 |
| FR | 2 645 719 | A1 | 10/1990 |
| JP | 59-113326 | U | 7/1984 |
| JP | 59 125902 | A | 7/1984 |
| JP | 10-53915 | A | 2/1998 |
| JP | 3050720 | U | 5/1998 |
| JP | 3046820 | B1 | 3/2000 |

* cited by examiner

*Primary Examiner* — Christopher Harmon
(74) *Attorney, Agent, or Firm* — Birch, Stewart, Kolasch & Birch, LLP

(57) ABSTRACT

To facilitate driving and prevent a fatigue in a neck by avoiding fluctuations of a helmet to left and right even in a wind (air flow) of a high relative speed thereby stabilizing the helmet. A wake stabilizer for the helmet has a right stabilizer (10R) and a left stabilizer (10L) provided symmetrically at the body wake flow portions (9) on the left and right sides of the helmet. Each of the left and right stabilizers (10R, 10L) has a side straightening face (15) extending from the side face position of the body wake flow portion (9) to the rear surface at such an angle as being fitted on the back of the helmet while being kept flat, and a wind separating portion (16) providing a longitudinal edge extending perpendicularly on a rear edge.

7 Claims, 15 Drawing Sheets

WAKE STABILIZER FOR HELMET AND HELMET

TECHNICAL FIELD

The present invention relates to a wake stabilizer for a helmet and a helmet.

BACKGROUND ART

The applicant of the present invention previously developed a wake straightener attached to a helmet and a helmet with the wake straighteners so as to prevent the helmet from being pulled back by wind pressure when a user drives a motorcycle while putting on the helmet, and filed an application of the wake straightener and the helmet (see Patent Document 1). This wake straightener is designed to introduce an airflow going beyond a top of the helmet to be separated at a rear position as far from the helmet as possible, and to suppress generation of negative pressure in rear portions of the helmet. In a side view, the wake straightener has a structure with a flat top portion extending rearward to be continuous tangentially from the top of the helmet (near an uppermost portion thereof in a driving posture).

Patent Document 1: Japanese Utility Model Registration No. 3050720

DISCLOSURE OF THE INVENTION

Problems to be Solved by the Invention

A helmet including the wake straighteners according to the application filed by the applicant of the present invention is highly evaluated on the market since the helmet can sufficiently suppress the phenomenon that the helmet is pulled backward by wind pressure.

Meanwhile, in a race requiring running at high speed exceeding 200 km/h, a helmet is exposed to wind pressure far beyond prediction made for running on a general road. At this time, the helmet is a generation source generating vortexes in rear regions of the helmet in the wind (airflow) passing through both of left and right sides of the helmet. In the case where relative speeds of the helmet and the airflow are relatively low, the generated vortexes are twin vortexes generated coincidentally on the both of the left and right sides of the helmet (arranged symmetrically). However, in the case where the relative speeds are higher, vortex generation timings of left and right vortexes alternate and the vortexes are changed to so-called Carman vortexes. In the case where the relative speeds are further higher (during running at high speed exceeding, for example, 300 km/h), the vortexes turn turbulent flows.

In this way, when the vortexes are generated in states of Carman vortexes through turbulent flows in left and right rear regions of the helmet, a left-right imbalance fluctuation force acts on the helmet and possibly adversely influences a driving posture of a motorcycle. Further, a problem of causing frequent fatigue in the user's neck occurs.

The present invention has been made in light of the above-stated circumstances. It is an object of the present invention to provide a wake stabilizer for a helmet capable of avoiding fluctuations of the helmet to the left and right and stabilizing the helmet, thereby facilitating driving and preventing a fatigue in the neck even in a wind (airflow) having a high relative speed and a helmet including such wake stabilizers.

Problems to be Solved by the Invention

In order to attain the above object, the following means are adopted in the present application.

Namely, a wake stabilizer for a helmet according to the present application comprises: a left stabilizer and a right stabilizer each provided on both sides of left and right body wake flow portions forming a partially spherical area ranging from a side surface of the helmet to a rear surface of the helmet, respectively to be arranged bilaterally symmetric about the body wake flow portions. In the wake stabilizer for a helmet, each of the left and right stabilizers includes:

a side flow-straightening face extending from a side surface position of the body wake flow portion to the rear surface at an angle at which the side flow-straightening face is within a back of the helmet while being kept flat; and a wind separating portion generating a longitudinal edge extending perpendicularly on a rear edge of the side flow-straightening face.

By providing such a wake stabilizer on the helmet, a wind (airflow) passing through both of left and right sides of the helmet is introduced to a rear position as far from the helmet as possible along a side flow-straightening face and smoothly separated from a wind separating portion provided as the rear edge of this side flow-straightening face.

Due to this, generation of vortexes as Carman vortexes or those in a turbulent flow state is suppressed in rear portions of the helmet and generation of negative pressure in the rear portions is eventually suppressed. Therefore, even in the wind (airflow) having a high relative speed, fluctuations of the helmet to the left and right are avoided and the helmet is stabilized. It is thereby possible to facilitate driving a motorcycle or the like and a driver advantageously feels less fatigue in the driver's neck.

The wake stabilizer according to the present invention may be configured so that the left and right side flow-straightening faces and the wind separating portion are integrally coupled to each other in a state in which the left and right side flow-straightening faces and the wind separating portion are across a rear portion of a body wake flow portion.

It is preferable that the side flow-straightening face is formed into a thin plate shape using a resin material. By doing so, the wake stabilizer can be made lighter in weight and a weight burden of the entire helmet can be suppressed. It is also possible to advantageously prevent cost increase.

The helmet according to the present application comprises the wake stabilizer for the helmet as stated above, wherein the wake stabilizer for the helmet is provided with respect to the body wake flow portion in an integrally posterior state or a separately posterior state.

The "integrally posterior state" means a state including an attachment state in which the wake stabilizer produced as a separate component is attached to the helmet by an appropriate fixing method such as bonding using adhesive, FRP or the like, caulking or screwing in a helmet manufacturing phase and a completion state in which the helmet is completed. The "separately posterior state" means a state in which the wake stabilizer is attached to the helmet completed as a distributed product by an appropriate fixing method.

Namely, the helmet according to the present invention is constituted by attaching the wake stabilizer according to the present invention to the helmet including a basic configuration whether the helmet is in a manufacturing phase or a distribution phase.

In the case where the "separately posterior state" is worked, a bonding method using a double-sided adhesive tape is available besides the above-stated appropriate fixing methods. Further, the "separately posterior state" includes an instance of structuring the helmet and the wake stabilizer to be detachable from each other by using a face fastener, a button hook or the like.

Alternatively, the wake stabilizer may be integrated with the helmet initially (that is, as part of the helmet) instead of the wake stabilizer in the "integrally posterior state" or "separately posterior state". Namely, in the helmet comprises a wake stabilizer including:

the side flow-straightening faces extending rearward from bilaterally symmetric side surface positions of both sides of a body of the helmet at an angle at which the side flow-straightening faces are within a back of the helmet while being kept flat, respectively; and the wind separating portion generating a longitudinal edge extending perpendicularly on a rear edge of the side flow-straightening faces.

In this case, there is no need for the wake stabilizer to be completed as a state before being attached to the body of the helmet. It suffices that the wake stabilizer is included in a part of the configuration of the helmet as the completed helmet. (The present invention includes, for example, an instance in which a component for forming the side flow-straightening face and a component for forming the wind separating portion are provided as separate components, an instance in which the wake stabilizer is formed to be provided as the body of the helmet itself, and the like).

The wind separating portion may be each of a pair of left and right wind separating portions in a state of generating longitudinal edges on separately provided rear edges of the left and right side flow-straightening faces, respectively. It is to be noted that it suffices to provide only one wind separating portion by providing one rear edge so as to be shared between the left and right side flow-straightening faces (so that the rear edges of the left and right side flow-straightening faces abut against each other) and by forming this rear edge into a longitudinal edge. The present invention may include such an instance.

The helmet according to the present application may comprise a rear spoiler including:

a top flow-straightening face extending rearward from a body top portion at an angle at which the top flow-straightening face is within the back of the helmet while being kept flat; and a wind separating portion generating a lateral edge extending horizontally on a rear edge of the top flow-straightening face. In this case, the wake stabilizer may be provided at a lower level than the rear spoiler on a lateral edge of the rear spoiler serving as a boundary between the wake stabilizer and the rear spoiler.

By so configuring, it is advantageously possible to suppress the generation of vortexes such as Carman vortexes or those in the turbulent flow state against not only the wind (airflow) passing through both of left and right sides of the helmet but also the wind (airflow) going beyond a top portion of the helmet.

The body of the helmet including the wake stabilizer and the rear spoiler is entirely formed integrally.

Effects of the Invention

The wake stabilizer for the helmet according to the present invention and the helmet including the wake stabilizers according to the present invention can avoid fluctuations of the helmet to the left and right even in the wind (airflow) having a high relative speed, and the helmet is stabilized. It is, therefore, advantageously possible to facilitate driving a motorcycle or the like and let the user feel less fatigue.

DESCRIPTION OF REFERENCE NUMERALS

Figure 1:
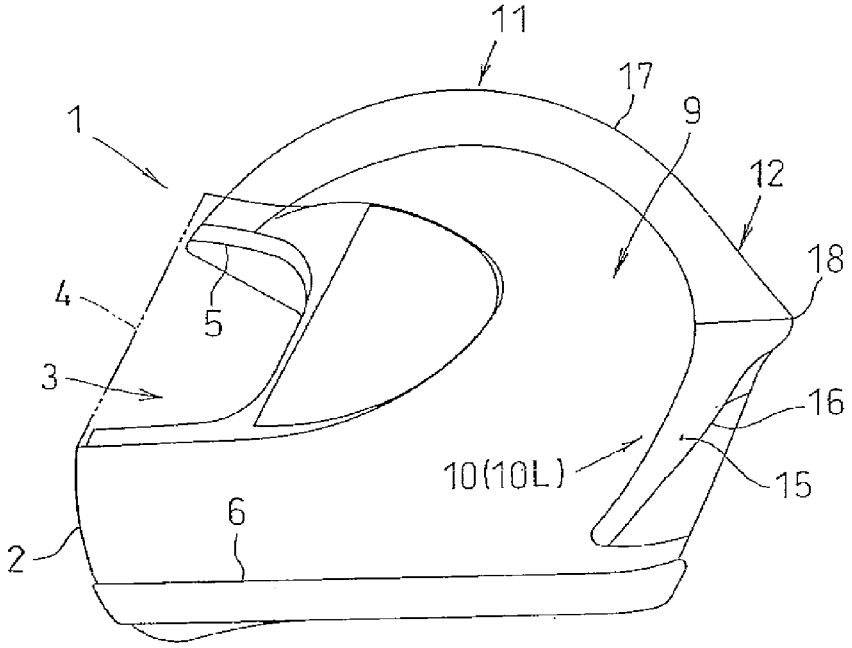
FIG. 1 is a side view in accordance with a first embodiment of a helmet of the present invention.
Figure 2:
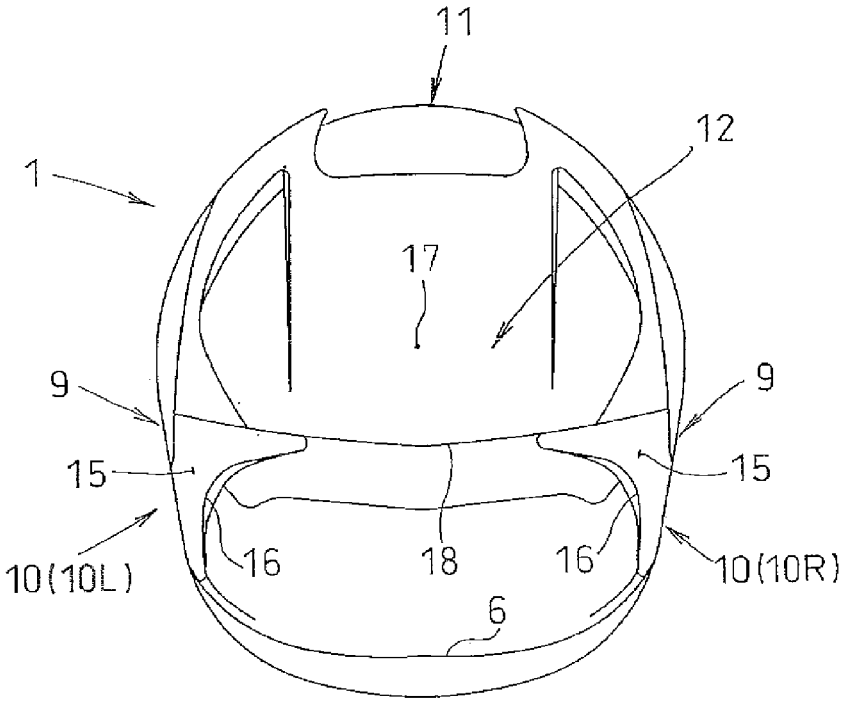
FIG. 2 is a back view according to FIG. 1.

1 helmet
9 body wake flow portion
10 wake stabilizer
10L left stabilizer
10R right stabilizer
12 rear spoiler
15 side flow-straightening face
16 wind separating portion
17 top flow-straightening face
18 wind separating portion
21 coupling portion

BEST MODE FOR CARRYING OUT THE INVENTION

Embodiments of the present invention will be described hereinafter based on the drawings.

FIGS. 1 to 4 show a first embodiment of a helmet 1 according to the present invention. The helmet 1 according to the first embodiment is a full-face helmet, and a chin guard 2 is provided on a front surface of the helmet 1, thereby forming an independent eye opening 3. This eye opening 3 can be freely opened or closed by a shield 4 attached to the helmet 1. Although not shown in the drawings, a ventilation part is provided in an upper portion (corresponding to a wearer's forehead) or a lower portion (corresponding to a wearer's chin) of the eye opening 3, and an exhaust part is provided in an appropriate portion on a rear surface of the helmet.

The helmet 1 is similar in a cross-sectional structure to an ordinary helmet. Surroundings of a shock absorbing liner formed to cover up the wearer's head and made of a foamed material are covered with a body made of resin excellent in shock resistance and wear resistance. Further, an interior matter is appropriately bonded to an inner surface of the shock absorbing liner (which surface contacts with the wearer's head). Trimming materials 5 and 6 made of an elastic material are provided on a peripheral portion of the eye opening 3 and an outer peripheral portion of a lower end of the body, respectively.

Wake stabilizers 10 are provided on this helmet 1 to be laterally symmetric about body wake flow portions 9. The "body wake flow portion 9" corresponds to a partially spherical area ranging from a side surface to the rear surface of the helmet 1. Furthermore, a rear spoiler 12 is provided on the helmet 1 to a range from a body top portion 11 to the rear surface.

The wake stabilizers 10 include a left stabilizer 10L provided on a left side of the helmet 1 and a right stabilizer 10R provided on a right side thereof. The left and right stabilizers 10L and 10R are paired with each other. Each of the left and right stabilizers 10L and 10R is formed into a thin plate shape using a resin material such as carbon-based resin, e.g., polycarbonate or FRP, light in weight and having a predetermined strength, and adhesively fixed to the body.

The left stabilizer 10L and the right stabilizer 10R are bilaterally symmetric in terms of shape and arrangement. The left stabilizer 10L and the right stabilizer 10R are similar in a basic configuration, i.e., basically configured to include a side flow-straightening face 15 and a wind separating portion 16.

The side flow-straightening face 15 extends rearward from a side surface position of the body wake flow portion 9 at an angle at which the side flow-straightening face 15 is within a back of the helmet 1 while being kept flat. Accordingly, in a front view of the helmet 1, the side flow-straightening face 15 is within a projection region of the helmet 1 and invisible. In other words, this side flow-straightening face 15 does not act as air resistance per se.

Figure 3:
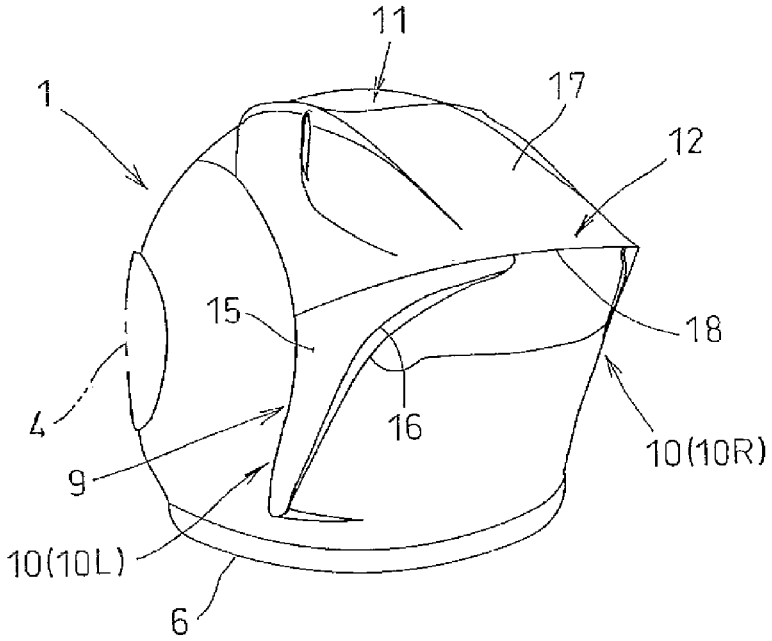
FIG. 3 is a perspective view showing from diagonally backward place where is intermediate between FIG. 1 and FIG. 2.
Figure 4:
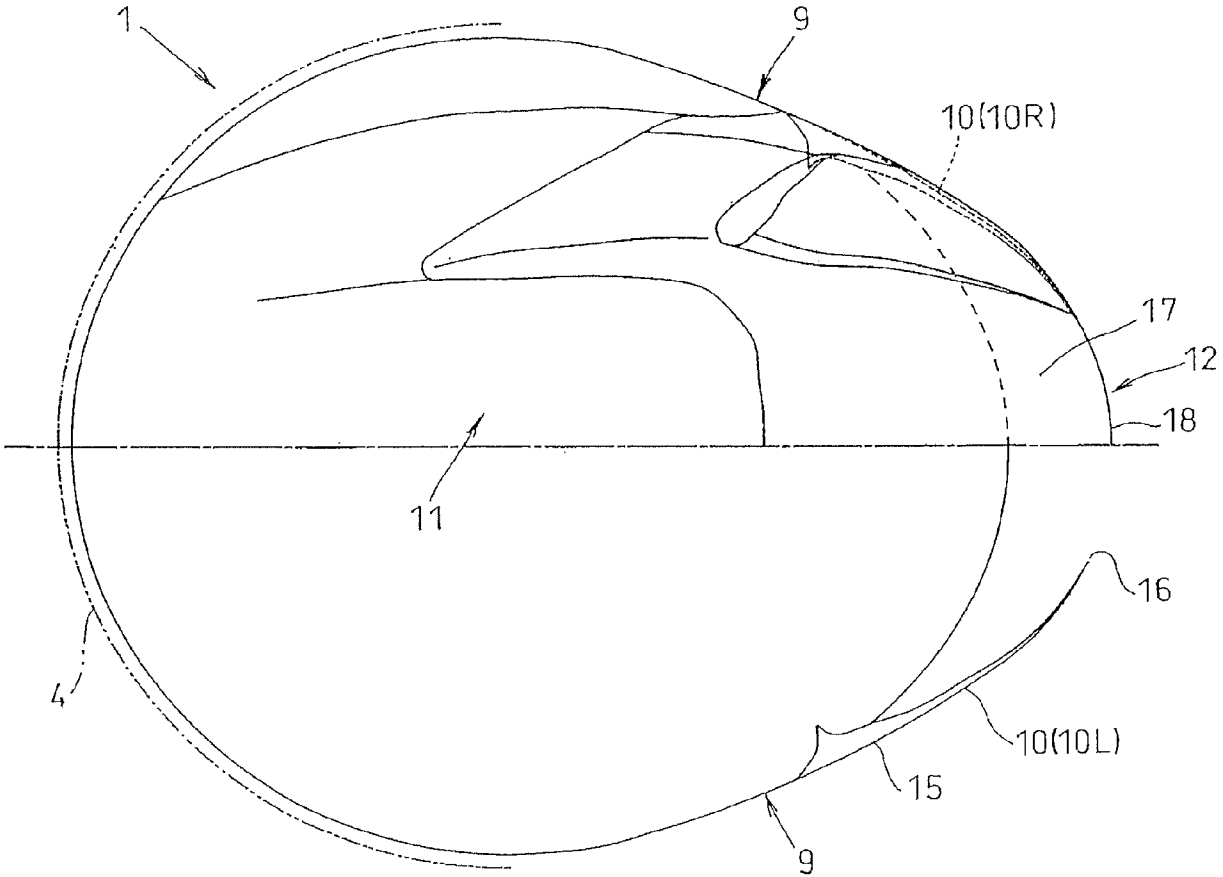
FIG. 4 is an enlarged plan view according to FIG. 1 (A rear spoiler on lower half part of FIG. 4 is omitted).

As evident from FIGS. 3 and 4, the side flow-straightening face 15 is formed to be gently curved in a plan view although the side flow-straightening face 15 is described as being flat. The side flow-straightening face 15 is intended not to disturb a rounded outline of the overall helmet 1 without increasing the air resistance.

The wind separating portion 16 is formed to generate a longitudinal edge extending perpendicularly on a rear edge of the side flow-straightening face 15. By providing this wind separating portion 16, an airflow along the side flow-straightening face 15 can be separated (cut off) satisfactorily and smoothly. Further, following presence of this wind separating portion 16, a length of the side flow-straightening face 15 extending rearward can be limited to a specific length, the left stabilizer 10L and the right stabilizer 10R can be arranged to be accurately symmetric, and flow-straightening functions of the left stabilizer 10L and the right stabilizer 10R are kept in good balance, accordingly.

The rear spoiler 12 includes a top flow-straightening face 17 extending rearward from the body top portion 11 at an angle at which the top flow-straightening face 17 is within the back of the helmet 1 while being kept flat and a wind separating portion 18 forming a lateral edge extending horizontally on a rear edge of this top flow-straightening face 17. The above-stated wake stabilizers 10 (left stabilizer 10L and right stabilizer 10R) are provided so as to be at a lower level than the rear spoiler 12 on a lateral edge of the rear spoiler 12 serving as a boundary between the wake stabilizers 10 and the rear spoiler 12.

In the case where the helmet 1 configured as stated above according to the first embodiment is put in the wind, a wind (airflow) passing through both of left and right sides of the helmet 1 is introduced up to a rear position as far from the helmet 1 as possible along the side flow-straightening face 15 and separated from the wind separating portion 16 provided as the rear edge of the side flow-straightening face 15. Due to this, generation of vortexes in the form of Carman vortexes or vortexes in a turbulent flow state is suppressed in the rear portions of the helmet 1, and generation of negative pressure in the rear portions of the helmet 1 is eventually suppressed.

Therefore, fluctuations of the helmet 1 to the left and right are avoided even in the wind (airflow) having a high relative speed and the helmet is stabilized, thereby facilitating driving a motorcycle or the like.

Furthermore, since the rear spoiler 12 is provided, generation of Carman vortexes or vortexes in the turbulent flow state can be advantageously suppressed even for the wind (airflow) going beyond a top of the helmet 1.

Figure 5A:
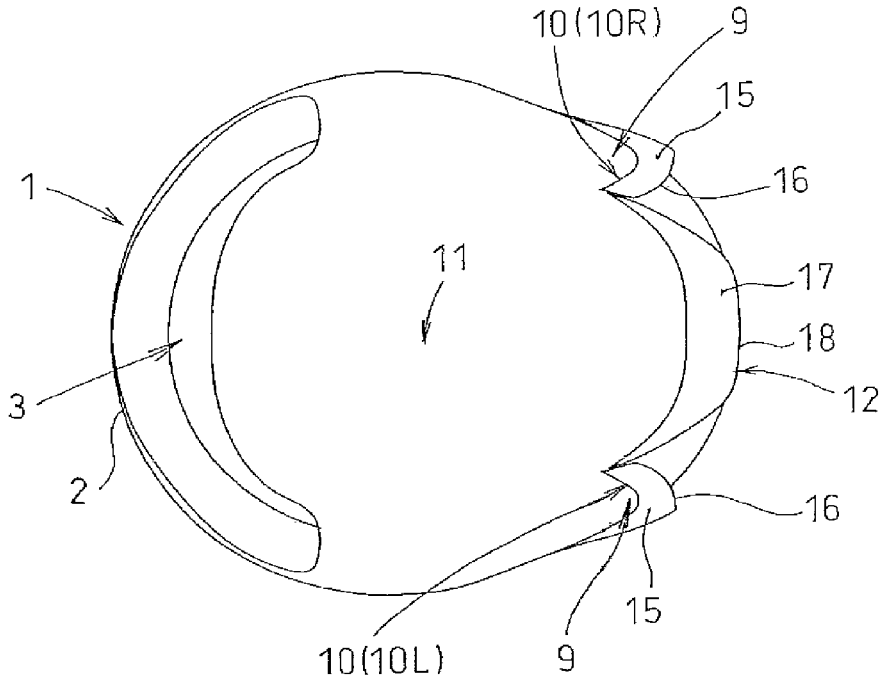
FIG. 5A is a plan view in accordance with a second embodiment of the helmet of the present invention.
Figure 5B:
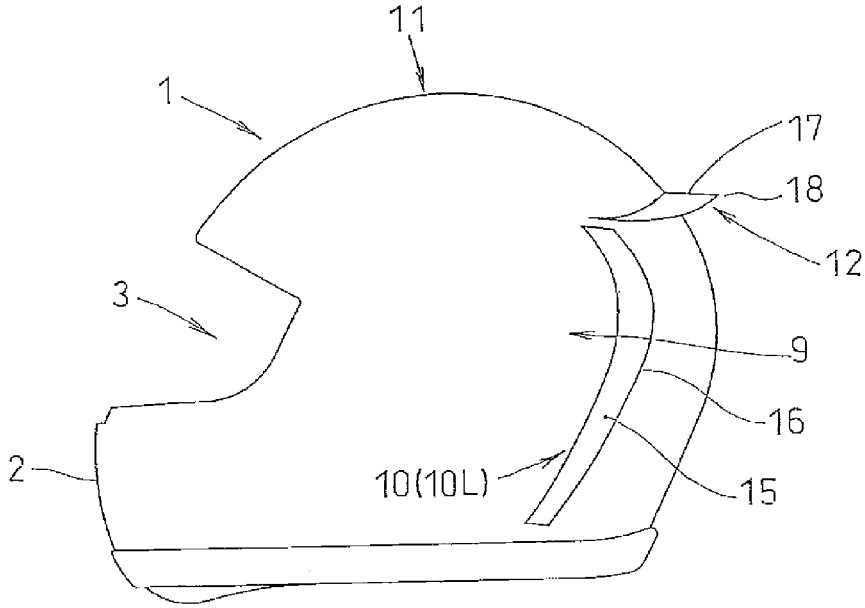
FIG. 5B is a side view according to FIG. 5A.

FIGS. 5A and 5B show a second embodiment of the helmet 1 according to the present invention. Each of the wake stabilizers 10 (left stabilizer 10L and right stabilizer 10R) adopted in the helmet 1 according to the second embodiment is formed out of a boomerang-like thin plate strip and attached to the body wake flow portion 9 in the form of an earlobe. Likewise, the rear spoiler 12 is formed out of a boomerang-like thin plat strip.

Figure 6:
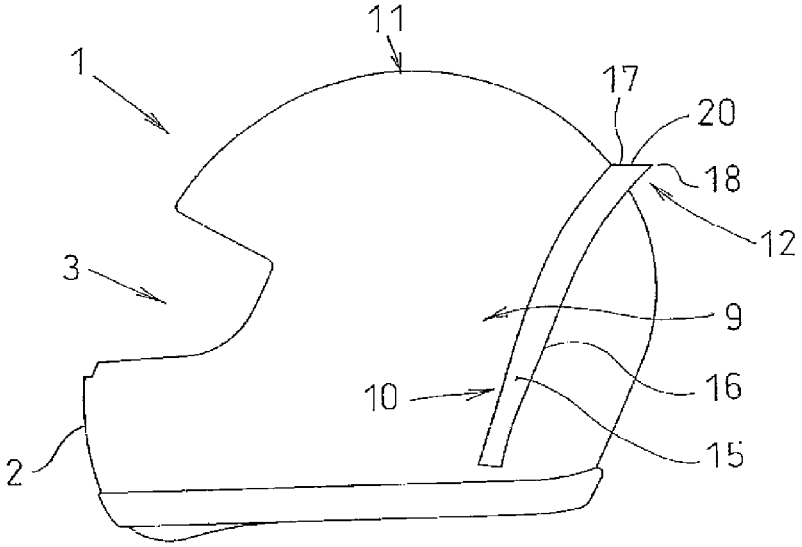
FIG. 6 is a side view in accordance with a third embodiment of the helmet of the present invention.

FIG. 6 shows a third embodiment of the helmet 1 according to the present invention. The wake stabilizers 10 adopted in the helmet 1 according to the third embodiment are not formed so that the left stabilizer 10L and the right stabilizer 10R are independent of each other but formed so that left and right side flow-straightening faces 15 are coupled together via a coupling portion 20.

Although the left and right side flow-straightening faces 15 and the coupling portion 20 are structured not to be clearly distinguishable, the left and right wind separating portions 16 are provided by longitudinal edges in a perpendicular direction formed as rear edges of the left and right flow-straightening faces 15.

The coupling portion 20 is provided to be across an upper portion of the body wake flow portion 9 (near a boundary between the body wake flow portion 9 and the body top portion 11). Due to this, the coupling portion 20 forms the rear spoiler 12 that includes the top flow-straightening face 17 extending rearward from the body top portion 11 at an angle at which the top flow-straightening face 17 is within the back of the helmet 1 while being kept flat and the wind separating portion 18 forming the lateral edge extending horizontally on the rear edge of this top flow-straightening face 17.

Figure 7:
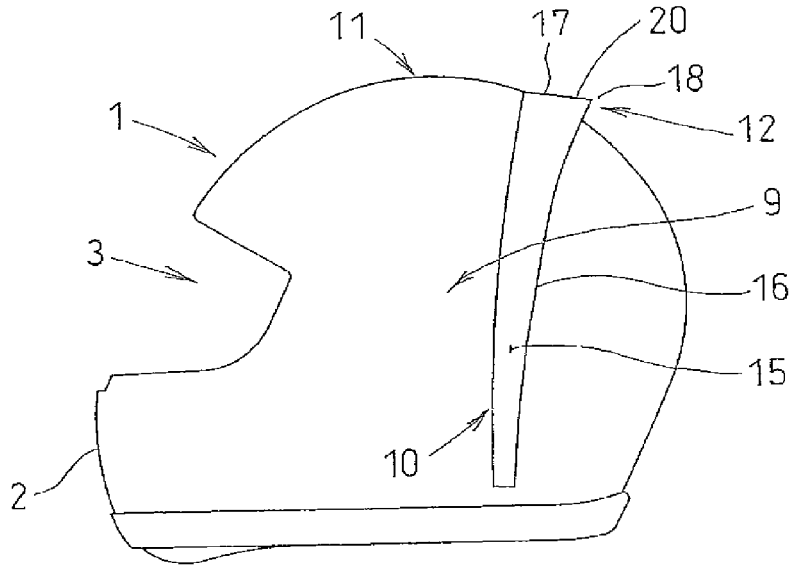
FIG. 7 is a side view in accordance with a fourth embodiment of the helmet of the present invention.

FIG. 7 shows a fourth embodiment of the helmet 1 according to the present invention. The fourth embodiment is similar to the above-stated third embodiment except that the coupling portion 20 of the wake stabilizers 10 (that is, the portion forming the rear spoiler 12) is located on the body top portion 11.

This is a result of adjusting an angle of use as the helmet 1 and an angle of action as the rear spoiler 12. Namely, the helmet 1 in the fourth embodiment is adapted to an instance in which a state in which the driver (helmet wearer) of an open convertible (automobile) or the like faces front is set to the driving posture.

It is notable that the change in attachment positions of the wake stabilizers 10 on the helmet 1 as stated above can advantageously make the present invention flexible as to the case of adopting a method of posteriorly attaching the wake stabilizers 10 by adhesive, a face fastener or the like.

Figure 8:
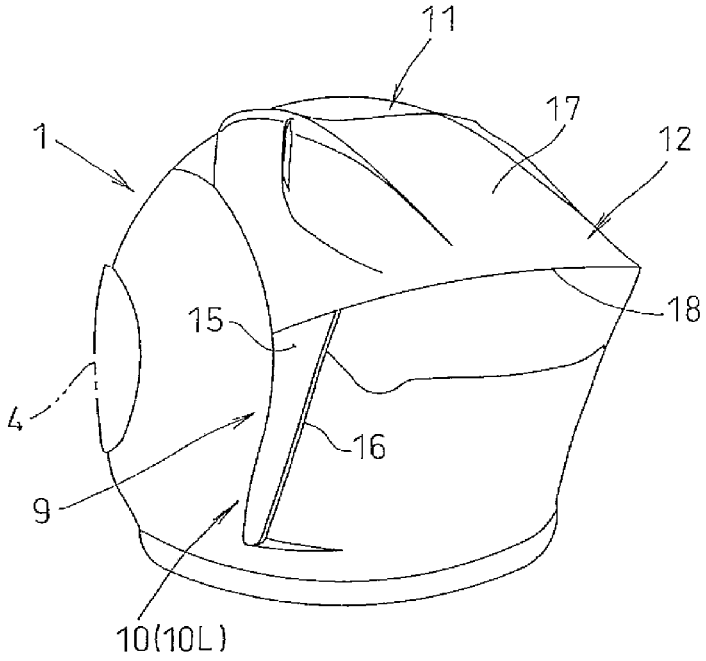
FIG. 8 is a perspective view showing from diagonally backward place in accordance with a fifth embodiment of the helmet of the present invention.

FIG. 8 shows a fifth embodiment of the helmet 1 according to the present invention. The helmet 1 according to the fifth embodiment is almost similar to the helmet 1 (see FIGS. 1 to 4) according to the above-stated first embodiment except that the helmet 1 according to the fifth embodiment is an instance in which the left stabilizer 10L and the right stabilizer 10R of the wake stabilizers 10 are formed out of elongated plate pieces, respectively and combined with the rear spoiler 12.

Namely, it can be explained that the helmet 1 according to the fifth embodiment is obtained by adopting a proposed structure (of making the wake stabilizers 10 small-sized components as the left stabilizer 10L and the right stabilizer 10R) according to the second embodiment (see FIGS. 5A and 5B) to the wake stabilizers 10 for the helmet 1 according to the first embodiment. The rear spoiler 12 is identical as that described in the first embodiment per se.

Figure 9:
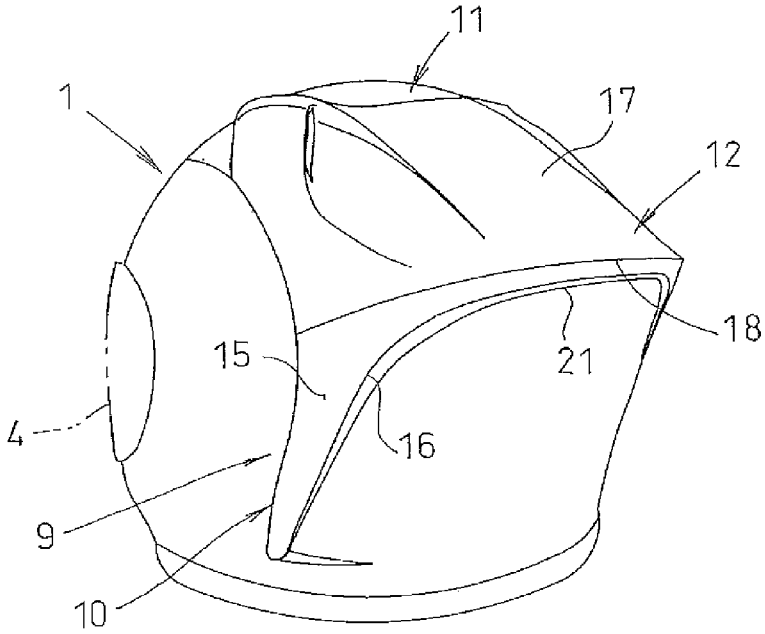
FIG. 9 is a perspective view showing from diagonally backward place in accordance with a sixth embodiment of the helmet of the present invention.

FIG. 9 shows a sixth embodiment of the helmet 1 according to the present invention. The sixth embodiment shows an instance in which the wake stabilizers 10 adopted in the helmet 1 according to the sixth embodiment are not formed so that the left stabilizer 10L and the right stabilizer 10R are independent of each other but formed so that left and right side flow-straightening faces 15 are coupled together via a coupling portion 21 provided to be across the body wake flow portion 9. The wind separating portion 16 is provided on each of rear edges of the left and right side flow-straightening faces 15.

As the rear spoiler 12, the same as that described in the first embodiment is adopted. The coupling portion 21 coupling the left and right side flow-straightening faces 15 together does not function as the rear spoiler 12 particularly strongly. Namely, it can be said that the helmet 1 according to the sixth embodiment differs from those of the proposed structures according to the third and fourth embodiments (see FIGS. 6 and 7) in that the wake stabilizers 10 are combined with the rear spoiler 12.

Figure 10:
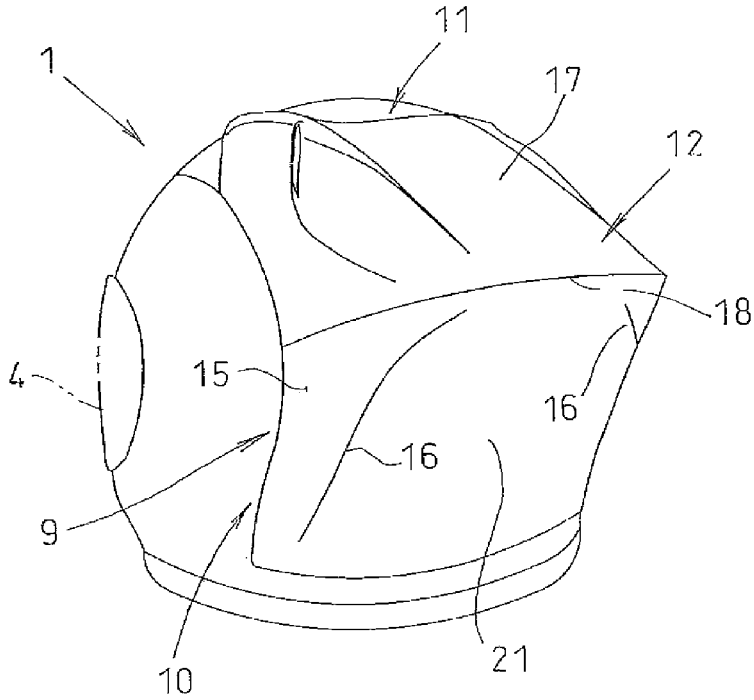
FIG. 10 is a perspective view showing from diagonally backward place in accordance with a seventh embodiment of the helmet of the present invention.

FIG. 10 shows a seventh embodiment of the helmet 1 according to the present invention. The helmet 1 according to the seventh embodiment is a so-called advanced type of the helmet 1 according to the sixth embodiment (see FIG. 9). The wake stabilizers 10 are configured so that the coupling portion 21 coupling the left and right side flow-straightening faces 15 together is formed as a plane portion enlarged up to near a bottom position of the body wake flow portion 9.

Rising portions in the form of mountain ranges along the perpendicular direction are provided in portions serving as boundaries between the left and right side flow-straightening faces 15 and the coupling portion 21, respectively. The rising portions serve as the wind separating portions 16. It is to be noted that the rear spoiler 12 is combined with upper portions of the wake stabilizers 10.

Figure 11A:
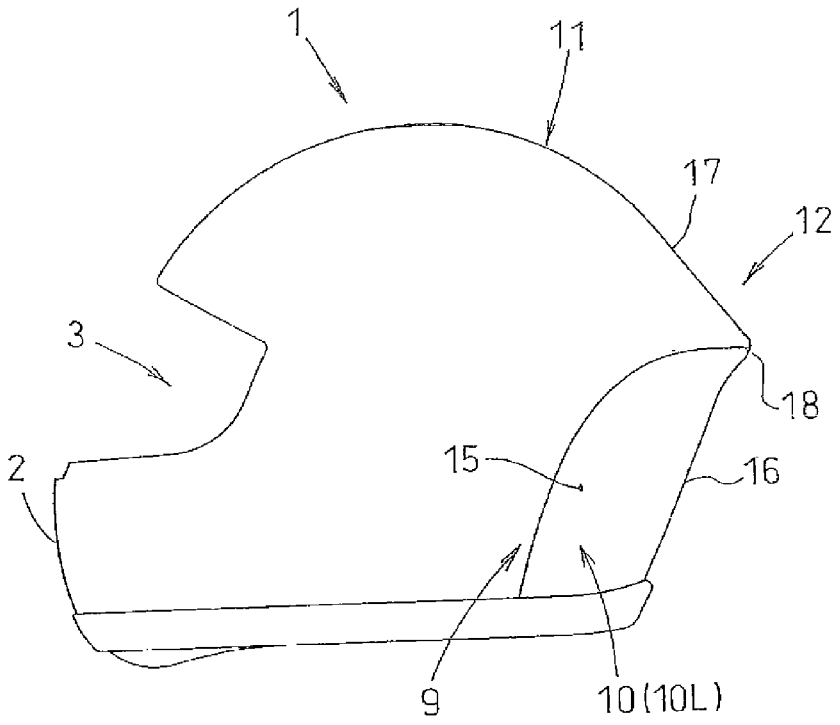
FIG. 11A is a side view in accordance with an eighth embodiment of the helmet of the present invention.
Figure 11B:
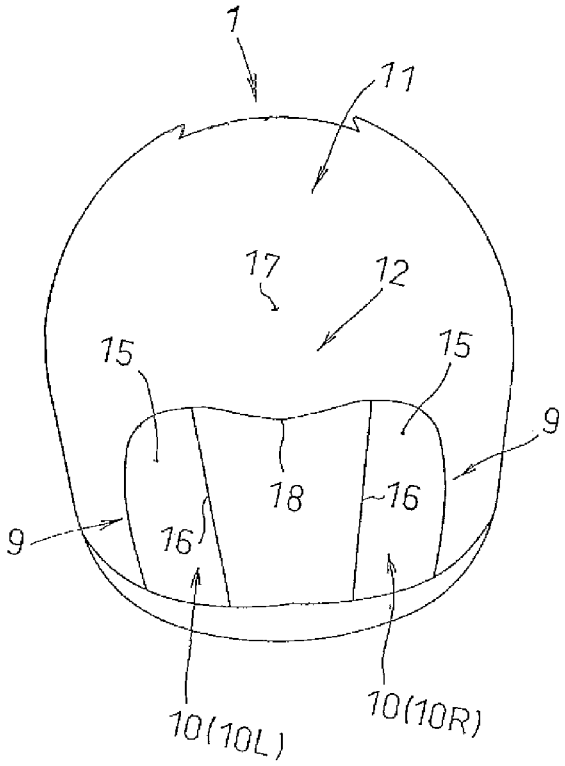
FIG. 11B is a back view according to FIG. 11A.

FIGS. 11A and 11B show an eighth embodiment of the helmet 1 according to the present invention. The helmet 1 according to the eighth embodiment is configured so that an entire body of the helmet 1 including the wake stabilizers 10 and the rear spoiler 12 is formed integrally. The wake stabilizers 10 are zoned into the left stabilizer 10L and the right stabilizer 10R, and each of the left stabilizer 10L and the right stabilizer 10R includes the side flow-straightening face 15 and the wind separating portion 16.

The wind separating portion 16 of each of the left stabilizer 10L and the right stabilizer 10R is formed as a line continuous to the wind separating portion 18 provided as the rear spoiler 12, so that the wind separating portion 16 is an accent in appearance that can express a sense of speed.

Figure 12A:
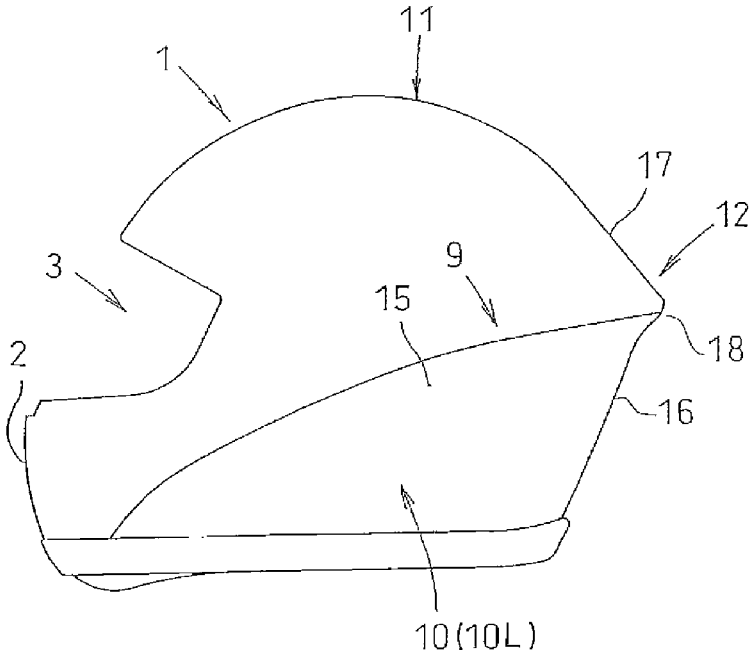
FIG. 12A is a side view in accordance with a ninth embodiment of the helmet of the present invention.
Figure 12B:
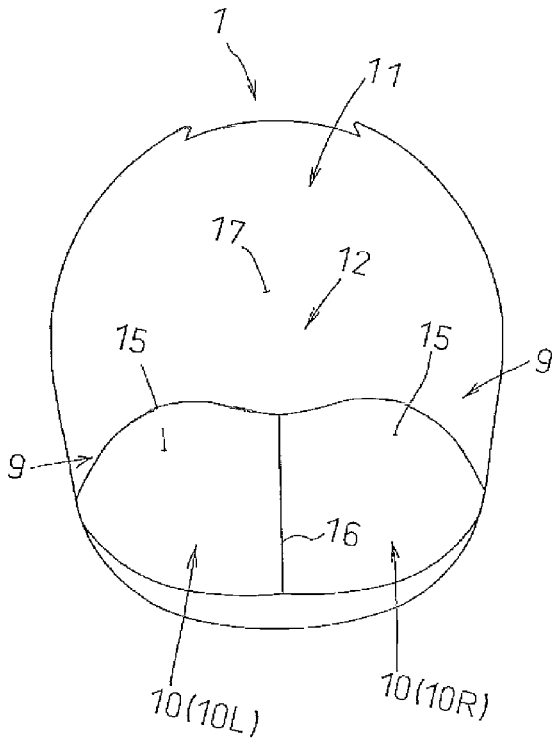
FIG. 12B is a back view according to FIG. 12A.

FIGS. 12A and 12B show a ninth embodiment of the helmet 1 according to the present invention. Similarly to the eighth embodiment (see FIGS. 11A and 11B), the helmet 1 according to the ninth embodiment is configured so that the entire body of the helmet 1 including the wake stabilizers 10 and the rear spoiler 12 is formed integrally. However, one rear edge is provided so as to be shared between the left and right side flow-straightening faces 15 (so that the rear edges of the left and right side flow-straightening faces abut against each other) and this rear edge is formed into a longitudinal edge, thereby forming one wind separating portion 16. As can be seen, the ninth embodiment differs from the eighth embodiment in that the helmet 1 includes only one wind separating portion 16.

Meanwhile, the present invention is not limited to the above-stated embodiments but can be appropriately changed according to the mode of carrying out the invention.

For example, the wake stabilizer for the helmet and the helmet according to the present invention are available not only to the instance of driving a motorcycle but also to every scene in which the wake stabilizer for the helmet and the helmet are predicted to be used in the wind (airflow) having the high relative speed.

The longitudinal edge for forming the wind separating portion 16 may be formed not only to be angular at a sharp angle but also to be slightly thick, to be thick and chamfered into an R shape or the like. In other words, a degree of the edge is not limited to a specific degree as long as the edge is formed to such a degree as to function to smoothly separate an airflow along this side flow-straightening face 15.

Moreover, an angle with respect to the perpendicular direction (angle with respect to a plumb line) of the longitudinal edge for forming this wind separating portion 16 is not limited to a specific angle.

No limitations are given to an external shape and a sectional structure of the helmet 1. The helmet 1 may be a jet helmet or the like. Alternatively, in the case where there is a space for the body wake flow portion 9 if any, the helmet 1 can be often carried out as a brimless half-type helmet (halved egg type helmet), a brim half-type (baseball cap type) helmet or the like.

INDUSTRIAL APPLICABILITY

The present invention is suitably used for a helmet for protecting the head of a driver of a two-wheeled motor vehicle, a bicycle, a racing car or the like. However, the present invention exhibit similar functions and advantages even in use for helmets of other purposes.

The invention claimed is:

1. A helmet comprising:

a wake stabilizer, the wake stabilizer including:

left and right side flow-straightening faces separately provided to two sides of the helmet and each independently extending rearward along the side surface of the helmet from bilaterally symmetric side surface positions of both sides of a body wake flow portion to a rear surface of the helmet, respectively, the bilaterally symmetric side surface positions being offset from a maximum width of the helmet toward the rear surface of the helmet; and a wind separating portion generating a longitudinal edge extending longitudinally on a rear edge of each of the left and right side flow-straightening faces, wherein the wind separating portion is each of a pair of left and right wind separating portions and configured to generate longitudinal edges on separately provided rear edges of the left and right side flow-straightening faces, respectively; and a rear spoiler, the rear spoiler including:

a top flow-straightening face extending rearward within the maximum width of the helmet from a body top portion toward the rear; and a wind separating portion generating a lateral edge extending horizontally on a rear edge of the top flow-straightening face, wherein the wake stabilizer is provided at a lower level than the rear spoiler below the lateral edge of the rear spoiler, the lateral edge of the rear spoiler serving as a boundary between the wake stabilizer and the rear spoiler, and wherein the wind separating portion of the rear spoiler is arranged rearward of the helmet than the wind separating portion of the left and right side flow-straightening faces.

2. The helmet according to claim 1, wherein the body of the helmet including said wake stabilizer and said rear spoiler is entirely formed integrally.

3. The helmet according to claim 1, wherein the left and right side flow-straightening faces respectively extend substantially a half height of the helmet in a direction from a bottom of the helmet to a top surface of the helmet, and taper progressively inward along a direction from a front of the helmet to the rear surface of the helmet.

4. The helmet according to claim 1, wherein the wind separating portion of the wake stabilizer includes a left wind separating portion extending longitudinally on the rear edge of the left side flow-straightening face, and a right wind separating portion extending longitudinally on the rear edge of the right side flow-straightening face, the left side flow-straightening face and the left wind separating portion forming a left wake stabilizer, the right side flow-straightening face and the right wind separating portion forming a right wake stabilizer, and wherein each of the left and right side flow-straightening faces is formed flatly, and each of the left and right stabilizers is independent of each other.

5. The helmet according to claim 4, wherein each of said left and right side flow-straightening faces is formed into a thin plate shape using a resin material.

6. The helmet according to claim 4, wherein said helmet includes a left body wake flow portion and a right body wake flow portion, each of the left and right body wake flow portions forming a partially spherical area ranging from the side surface of the helmet to the rear surface of the helmet, and wherein the left and right wake stabilizers for the helmet are provided with respect to the left and right body wake flow portions, respectively, in an integrally posterior state or a separately posterior state.

7. The helmet according to claim 4, wherein the left and right side flow-straightening faces respectively extend substantially a half height of the helmet in a direction from a bottom of the helmet to the top surface of the helmet, and taper progressively inward along a direction from a front of the helmet to the rear surface of the helmet.

* * * * *